United States Patent [19]

Bestenreiner et al.

[11] 4,034,186

[45] July 5, 1977

[54] METHOD AND ARRANGEMENT FOR PREVENTING SHEETS FROM CHARRING IN COPYING MACHINES

[75] Inventors: Friedrich Bestenreiner, Grunwald; Dieter Giglberger, Unterhaching, both of Germany

[73] Assignee: AGFA-Gevaert, Aktiengesellschaft, Leverkusen, Germany

[22] Filed: Mar. 10, 1976

[21] Appl. No.: 665,382

[30] Foreign Application Priority Data

Mar. 15, 1975 Germany ..... 2511424

[52] U.S. Cl. ..... 219/216; 219/388; 250/319; 432/227

[51] Int. Cl.[2] ..... H05B 1/00; G03G 15/20

[58] Field of Search ..... 219/216, 388; 250/317, 250/319; 355/3; 432/59, 227

[56] References Cited

UNITED STATES PATENTS

| | | | |
|---|---|---|---|
| 3,697,722 | 10/1972 | Furuichi et al. | 219/216 |
| 3,748,088 | 7/1973 | Mooney et al. | 219/216 X |
| 3,920,328 | 11/1975 | Toto | 219/216 |

*Primary Examiner*—C. L. Albritton
*Attorney, Agent, or Firm*—Michael J. Striker

[57] ABSTRACT

In an electro-photographic copier of the type wherein an image is formed on an image-carrying sheet and is thereafter fixed by subjecting the sheet at a fixing station to the influence of heat, a combination comprises a heating device at the fixing station for fixing an image on a sheet, and a conveyor device for moving the heating device relative to a sheet located in the fixing station at a predetermined speed sufficient to permit the heating device to fix the image on the sheet and also to prevent charring of the latter. A sheet-advancing device advances a sheet through the fixing station in direction opposite to the direction of movement of the conveyor device so as to increase the relative speed between the heating device and the advancing sheet. The movement of the heating device relative to the sheet prevents charring or burning of the sheet in the event that the sheet-advancing device malfunctions and advances a sheet at speeds lower than its normally rated speed, including zero speed, i.e., complete breakdown.

12 Claims, 1 Drawing Figure

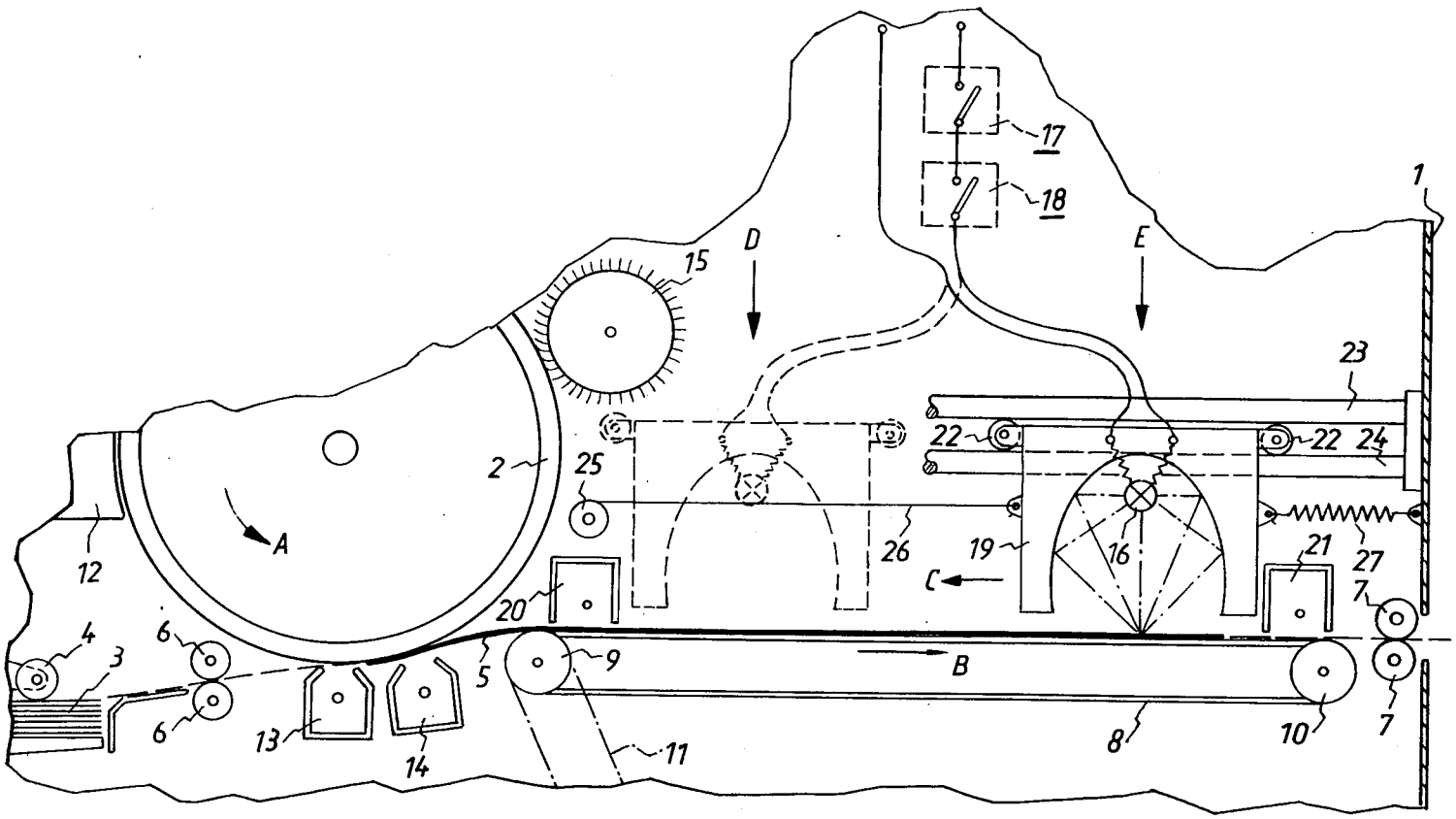
1
23
24
22
27
7
7
21
10
E
16
8
17
18
19
22
C
B
26
D
15
11
25
9
20
2
5
14
A
13
6
6
12
4
3

METHOD AND ARRANGEMENT FOR PREVENTING SHEETS FROM CHARRING IN COPYING MACHINES

BACKGROUND OF THE INVENTION

The present invention relates to copying machines and, more particularly, to a method and arrangement for preventing sheets from charring in such copying machines.

Electro-photographic reproducing machines or copiers of the type wherein an image is formed on an image-carrying sheet and is thereafter fixed by subjecting the sheet at a fixing station to the influence of heat are generally known in the art. Since the toner powder and/or the sheet have different optical and thermal characteristics, short bursts of heat energy are used to melt substantially only the toner powder on the sheet without causing the sheet itself to receive any significant amounts of heat which would otherwise damage the sheet. Reflective arrangements are also known which intensify the heat and thereby achieve some savings in input energy.

However, the prior art copiers have not proven altogether satisfactory in preventing the image-carrying sheets from being burned or charred in the event that the sheets take too long to be advanced through the work station where the toner powder is being fixed to the sheet. In particular, on account of the high heat energy density which is further intensified and directed by the reflective arrangement towards a sheet, the sheet tends to char in the event of partial or complete copier malfunction, that is, the movement of the sheet through the work station is either partially or substantially hindered. In either event, the sheet is exposed to image-fixing heat energy for too long a time and is damaged, thereby making the reproduced image unsatisfactory.

SUMMARY OF THE INVENTION

Accordingly, it is the general object of the present invention to overcome the disadvantages of the prior art.

An additional object of the present invention is to protect sheets employed in copiers from heat damage.

Yet another object of the present invention is to provide satisfactory image reproductions on image-carrying sheets.

In keeping with these objects, and others which will become apparent hereinafter, one feature of the invention resides, briefly stated, in a method and arrangements in an electro-photographic copier of the type wherein an image is formed on an image-carrying sheet and is thereafter fixed by subjecting the sheet at a fixing station to the influence of heat which comprises: heating means at said station for fixing an image on a sheet; and means for moving said heating means relative to a sheet located in said station at a predetermined speed sufficient to permit said heating means to fix the image on the sheet and also to prevent charring of the latter.

This feature of preventing charring by moving the heating means past the sheet being supplied with image-fixing heat energy prevents burning or charring of the sheet in a novel manner. The predetermined speed is selected to correspond to the speed normally required to permit all portions of a sheet to advance through the fixing station and be adequately fixed, that is, without any copier malfunction. Thus, the movement of the heating means guarantees that no one particular portion of a sheet being supplied with image-fixing heat energy will be furnished with too much of such heat energy due to copier malfunction.

Also, in accordance with the invention, the copier further comprises means for advancing a sheet through the fixing station in one direction which is opposite to the direction in which the moving means moves the heating means. This feature increases the relative speed between the heating means and the sheet. If the time duration in which adequate image-fixing is to occur is designed to correspond to this relatively higher speed, this increase in relative speed of the heating means permits the copier of the present invention to operate at speeds which are substantially higher than that of the advancing means alone. When installed in slow working copiers, the invention will substantially increase their operating speeds. When installed in faster-working copiers, the invention will not only still further increase their operating speeds but also substantially increase the efficiency of energy utilization.

Preferably, the heating means is a lamp which is elongated in a direction substantially normal to the direction in which the heating means and/or the sheet is moved and which is arranged in a reflective arrangement to intensify and direct the heating energy towards the sheet. This feature permits maximum utilization of the energy at the relatively high speeds generated in the manner described above. Of course, the shorter the time required for fixing an image onto a sheet, the more efficient and faster will be the operation of a copier in accordance with the present invention.

Also, in accordance with the invention, the predetermined speed at which the heating means is moved relative to the sheet is chosen so that the time period during which any particular sheet portion is exposed to the heat energy is shorter than the time period in which a stationary sheet begins to char. The minimum speed is the speed at which a sheet still has not yet begun to char; the maximum speed is the speed at which adequate fixing of the toner powder is just guaranteed.

Furthermore, the predetermined speed at which the heating means is moved and the fixing efficiency are so chosen that the time, which is required for a sheet to be fixed by toner powder, is so short that, even if a sheet were to remain stationary in the work station, no charring will occur.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The single FIGURE illustrates a partial diagrammatic view of a preferred embodiment in accordance with the present invention.

DESCRIPTION OF THE PREFERRED EMBODIMENTS

Referring to the drawing, it will be seen that reference numeral 1 generally identifies a housing of an electro-photographic copier of the type wherein an image is formed on an image-carrying sheet and is thereafter fixed by subjecting the sheet at a fixing station to the influence of heat.

Specifically, a drum 2 is mounted in housing 1 for rotary movement in direction of arrow A. The outer surface of the drum 2 is electrostatically charged in known manner at predetermined locations which correspond to the pattern of the image to be copied. Toner powder, which is adapted to melt when subjected to heat, is fed to the outer surface of the drum 2 by the device 12, and the powder is electrostatically attracted to the electrostatically charged outer surface of the drum 2. The toner powder particles thereby form the image pattern which will be subsequently transferred onto a sheet 5. The electrostatic formation of the image on the drum 2 and the deposition of towner powder thereon, are well known in the art and, consequently, further discussion of these aspects are not believed to be necessary since these features do not form part of the invention.

Likewise, in known manner, a feed roller 4 advances individual sheets 5 from a stack 3 in direction towards the transportation roller pair 6 which advances the sheets 5 towards the drum 2. A first corona-type device 13 generates an electrostatic force which pushes the sheet 5 against the drum 2 so that the toner powder arranged on the outer surface thereof will be transferred onto the sheet 5. A second corona-type device 14 downstream of the first corona-type device 13, as considered in direction of the advancement of a sheet 5 through the housing 1, is operative to generate an electrostatic force which pulls the sheet 5 off the drum 2. A cleaning wheel 15 located downstream of devices 13, 14 removes any powder particles which were not deposited on the sheet 5 and which may still remain on the outer surface of the drum 2.

In order to fix the powder particles in place on the sheet 5, heating means 16 is provided at a fixing station. Preferably, the heating means comprises an elongated lamp, e.g., an iodine quartz lamp. For transporting the sheet through the station, sheet-advancing means 8–11 are provided.

The advancing means comprises an endless conveyor belt 8 trained about tension rollers 9, 10. Roller 9 is driven by means of linkage 11 which is connected to a non-illustrated drive so as to advance a sheet 5 in direction of arrow B.

When a sheet 5 enters the fixing station, actuating means or switching device 17 actuates the heating lamp 16 so as to generate the heat energy required to melt and fix the loose powder particles onto the sheet 5. The actuating means 17 may be comprised of any electrical, mechanical, or analogous means. For example, a mechanically actuated key arranged to switch the heating lamp into an operative position when the sheet 5 is located at a predetermined position in the work station may be employed. Alternatively the actuating means 17 may be comprised of a photo-electrical circuit which switches the lamp 16 into an operative position when the sheet 5 interrupts a light beam which is directed across the path of the advancing sheet.

The light and heat radiated by the lamp 16 is concentrated and intensified by the elliptically shaped cylindrical reflector 19. The lamp 16 is positioned in one focal line of the ellipse and is transversely spaced from the advancing sheet 5 a distance substantially corresponding to the distance between the focii of the ellipse. Thus, the energy is focused onto the upper surface of sheet 5 or, more precisely, onto the powder-deposited layer formed on the sheet 5. In order to increase the concentration of the energy, the inner surface of the reflector 19 may be polished and be further provided with a reflective mirror-like coating.

Additional corona-type devices are provided on opposite sides of the fixing station. Device 20 is operative for holding the sheet 5 down onto the conveyor belt 8 during the fixing operation. Device 21 is operative for picking up the sheet 5 from the conveyor belt so that the sheet 5 can be advanced towards the transport roller pair 7 and be thereafter conveyed out of the housing 1.

In order to prevent charring or burning of the sheet 5 due to the high heat energy being focused onto the sheet 5 and/or due to a possible malfunction for any reason of the advancing means 8–11 in which event the sheet is advanced through the station at speeds smaller than normally rated speed, including substantially zero speed (i.e., complete breakdown), several anti-charring devices may be employed either alone or in combination.

For example, switching means 18 is connected with the latter for automatically deactuating the heating lamp 16 so as to reduce or shut off the lamp after a predetermined time interval has elapsed. This time interval is selected so as to at least permit the advancing means 8–11 to advance the sheet through the fixing station and fix the powder to the sheet without also exposing the sheet itself to heat damage.

A preferred example of such automatic deactuation is a timing switch which is preset at this predetermined time duration to turn off the lamp 16 after this predetermined time duration has elapsed. Such a switch may be mechanically actuated to shut off the lamp 16 after the predetermined time has passed, or may be actuated by any electric circuitry such as conventional delay-type circuitry. For example, resistive and capacitive elements having a time constant substantially equal to this predetermined time duration may be selected and connected with the heating means 16 to shut off the lamp 16 after the predetermined time has elapsed.

In addition, in accordance with the anti-charring feature of the invention, the heating means 16 is moved relative to a sheet 5 which is located in the station at a predetermined speed which is sufficient to permit the heating means to fix the image on the sheet. The moving means preferably comprises a towing arrangement in which a cable or analogous rope member 26 has an end connected with a lug secured to one side of the reflector housing of the heating means and an opposite end trained about cable pulley 25. Pulley 25 can be driven by a separate drive, or it can be driven by a non-illustrated transmission which couples the pulley 25 to the prime mover which drives the drum 2. In either event, the towing means is operative for moving the heating means 16 from initial position E towards final position D in the direction of arrow C which, it will be kept in mind, is opposite to the direction of arrow B in which the sheet is moved so as to increase the relative speed between the heating means 16 and the sheet 5.

Returning means or spring 27 has one end connected with a lug provided at the other side of the reflector housing 19 of the heating means 16 and its opposite end connected with the housing wall 1. In order to facilitate the movement of the heating means 16, rollers 22 are connected with the reflector housing 19 and are mounted for movement intermediate upper guide rail portion 23 and lower guide rail portion 24.

It is also possible if the sheet 5 has a heat capacity which is an order of magnitude higher than that of the toner powder and if the absorption characteristic of the sheet is an order of magnitude less than that of the toner powder. In other words, the amount of heating energy required for melting the toner powder can be increased on the order of 2 times before the heat would otherwise damage the sheet itself.

It will be understood that each of the elements described above, or two or more together, may also find a useful application in other types of constructions differing from the types described above.

While the invention has been illustrated and described as embodied in a method and arrangement for preventing sheets from charring in copying machines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In an electro-photographic copier of the type wherein an image is formed on an image-carrying sheet and is thereafter fixed by subjecting the sheet at a fixing station to the influence of heat, a combination comprising heating means at said station for fixing an image on a sheet; and means for moving said heating means relative to a sheet located in said station at a predetermined speed sufficient to permit said heating means to fix the image on the sheet and also to prevent charring of the latter.

2. A combination as defined in claim 1; and further comprising means for advancing a sheet through said station in one direction, and wherein said moving means moves said heating means in direction opposite to said one direction so as to increase the relative speed between said heating means and said sheet.

3. A combination as defined in claim 2, wherein said heating means is a radiating lamp elongated in direction substantially normal to said one direction.

4. A combination as defined in claim 1; and further comprising means for advancing a sheet through said station at rated speeds; and wherein said moving means moves said heating means through said station at said predetermined speed which is sufficient to prevent charring of the sheet in the event that the latter is advanced by said advancing means at speeds lower than said rated speeds, including substantially zero speed.

5. A combination as defined in claim 1; and further comprising means for advancing a sheet through said station; and further comprising actuating means for actuating said heating means when a sheet enters said station.

6. A combination as defined in claim 1; and further comprising means for automatically deactuating said heating means after a predetermined time interval has elapsed.

7. A combination as defined in claim 1, wherein said moving means comprises means for towing said heating means from an initial towards a final position, and also comprises means for returning said heating means from said final position towards said initial position.

8. A combination as defined in claim 7; and further comprising a guide rail mounted to the copier, and rollers connected with said heating means and mounted for movement on said guide rail.

9. A method of protecting image-carrying sheets in an electro-photographic copier of the type wherein an image is formed on a sheet and is thereafter fixed by subjecting the latter at a fixing station to the influence of heat, comprising the steps of actuating a heating device which is operative for supplying image-fixing heat energy to a sheet located in said station; and moving said heating device relative to the sheet located in said station at a predetermined speed sufficient to permit the heating device to fix the image on the sheet and also prevent charring of the latter.

10. A method as defined in claim 9; and further comprising the step of advancing a sheet through said station in one direction; and wherein said step of moving said heating device is performed by moving the latter in direction opposite to said one direction.

11. A method as defined in claim 9; and further comprising the step of advancing a sheet through said station at rated speeds, and wherein said step of moving said heating device is performed by moving the latter at said predetermined speed which is sufficient to prevent charring of the sheet in the event that the latter is advanced at speeds lower than said rated speeds.

12. A method as defined in claim 9; and further comprising the step of advancing a sheet through said station at rated speeds, and wherein said step of moving said heating device is performed by moving the latter at said predetermined speed which is sufficient to prevent charring of the sheet in the event that the latter is advanced at substantially zero speeds.

* * * * *